US007980087B2

(12) United States Patent
Anderson et al.

(10) Patent No.: US 7,980,087 B2
(45) Date of Patent: Jul. 19, 2011

(54) REFRIGERANT REHEAT CIRCUIT AND CHARGE CONTROL WITH TARGET SUBCOOLING

(75) Inventors: Justin M. Anderson, Clarksville, TN (US); James P. Crolius, La Crosse, WI (US); Robert F. Schult, Clarksville, TN (US); Roger J. Voorhis, Clarksville, TN (US)

(73) Assignee: Trane International Inc., Piscataway, NJ (US)

( * ) Notice: Subject to any disclaimer, the term of this patent is extended or adjusted under 35 U.S.C. 154(b) by 807 days.

(21) Appl. No.: 11/811,445

(22) Filed: Jun. 8, 2007

(65) Prior Publication Data

US 2008/0302112 A1 Dec. 11, 2008

(51) Int. Cl.
*F25B 29/00* (2006.01)

(52) U.S. Cl. ..... 62/173; 62/90; 62/159; 62/196.4

(58) Field of Classification Search ..... 62/93, 159, 62/160, 173, 196.4
See application file for complete search history.

(56) References Cited

U.S. PATENT DOCUMENTS

| | | | | |
|---|---|---|---|---|
| 1,837,798 | A | | 12/1931 | Shipley |
| 2,195,781 | A | | 4/1940 | Newton |
| 2,961,844 | A | | 11/1960 | McGrath |
| 3,203,196 | A | | 8/1965 | Malkoff |
| 3,316,730 | A | | 5/1967 | Lauer |
| 3,362,184 | A | | 1/1968 | Jensen |
| 5,088,295 | A | | 2/1992 | Shapiro-Baruch |
| 5,497,629 | A | * | 3/1996 | Rafalovich et al. ..... 62/98 |
| 6,055,818 | A | | 5/2000 | Valle et al. |
| 6,122,923 | A | | 9/2000 | Sullivan |
| 6,170,271 | B1 | | 1/2001 | Sullivan |
| 6,321,558 | B1 | | 11/2001 | Pruse |
| 6,381,970 | B1 | | 5/2002 | Eber et al. |
| 6,612,119 | B2 | | 9/2003 | Eber et al. |

(Continued)

FOREIGN PATENT DOCUMENTS

JP 2001-317831 11/2001

(Continued)

OTHER PUBLICATIONS

"Quick Facts: Superheat and Subcooling", by http://www.achrnews.com/Articles/Service_and_Maintenance/359c04c4a006a010VgnVCM100000f932a8c0, Jun. 12, 2005, 3 pages.*

*Primary Examiner* — Judy J Swann
*Assistant Examiner* — Paolo Gonzalez
(74) *Attorney, Agent, or Firm* — William O'Driscoll

(57) ABSTRACT

A refrigerant system for cooling a comfort zone is selectively operable in a cooling-only mode and a reheat mode. The system operates in the cooling mode to meet sensible and latent cooling demands of a room or area in a building when the room temperature is appreciably above a target temperature. The reheat mode is for addressing the latent cooling or dehumidifying demand when the room temperature is near or below the target temperature. In some embodiments, a generally inactive condenser stores excess refrigerant during the reheat mode, thereby avoiding the need for a separate liquid refrigerant receiver. To maintain a desired level of subcooling in the reheat coil, refrigerant can be transferred accordingly between the inactive condenser and the reheat coil. In some embodiments, the system's evaporator and reheat coil can be connected in a series or parallel flow relationship.

27 Claims, 5 Drawing Sheets

U.S. PATENT DOCUMENTS

| | | | | |
|---|---|---|---|---|
| 6,666,040 | B1 | 12/2003 | Groenewold et al. | |
| 6,826,921 | B1 | 12/2004 | Uselton | |
| 7,219,505 | B2 * | 5/2007 | Weber et al. | 62/90 |
| 7,770,411 | B2 * | 8/2010 | Knight et al. | 62/498 |
| 2005/0229612 | A1 * | 10/2005 | Hrejsa et al. | 62/149 |
| 2005/0241334 | A1 * | 11/2005 | Taras et al. | 62/513 |
| 2006/0010908 | A1 * | 1/2006 | Taras et al. | 62/513 |
| 2006/0064995 | A1 | 3/2006 | Rigal et al. | |
| 2006/0086115 | A1 * | 4/2006 | Weber et al. | 62/196.4 |
| 2008/0098756 | A1 * | 5/2008 | Uselton | 62/173 |

FOREIGN PATENT DOCUMENTS

| | | |
|---|---|---|
| JP | 2002-221353 | 8/2002 |
| WO | WO 2006128264 A1 * | 12/2006 |

* cited by examiner

REFRIGERANT REHEAT CIRCUIT AND CHARGE CONTROL WITH TARGET SUBCOOLING

BACKGROUND OF THE INVENTION

1. Field of the Invention

The subject invention generally pertains to refrigerant systems and more specifically to a refrigerant circuit that offers a reheat mode of operation.

2. Description of Related Art

Conventional refrigeration systems comprising a compressor, a condenser, an expansion valve and an evaporator can be used to meet the sensible and latent cooling demands of a room or area in a building when the room temperature is appreciably above a target temperature. In some circumstances, however, high humidity can leave a room feeling uncomfortable even though the room temperature might be at or even below the target temperature. Although further cooling of the room can reduce the humidity, the additional cooling can make the air in the room feel cold and dank.

To avoid this problem, many refrigerant systems include a reheat mode where a heater downstream of the evaporator raises the temperature of the supply air after the evaporator cools the air to reduce the humidity. Such systems can effectively address the latent cooling or dehumidifying demand without subcooling the room. Although the reheat mode can be provided by electric heat or combustion, the system can be less expensive to operate if the reheat is provided by the refrigerant circuit itself. In some cases, for instance, the compressor discharges relatively hot refrigerant gas into an additional heat exchanger that reheats the air that was previously cooled by the evaporator.

Using an additional heat exchanger in such a manner, however, can create a problem regarding the system's refrigerant charge. Air conditioning systems typically require less refrigerant during a reheat mode than during a cooling-only mode. Unless the system has some means for adjusting its refrigerant charge, the system might have an excessive amount of refrigerant during the reheat mode or an insufficient supply during the cooling mode. Thus, the system's efficiency might suffer in the cooling and/or reheat mode.

Previous systems addressing reheat and charge control include those shown in U.S. Pat. No. 6,122,923 to Sullivan; U.S. Pat. No. 6,170,271 to Sullivan; U.S. Pat. No. 6,381,970 to Eber et al.; and, U.S. Pat. No. 6,612,119 to Eber et al.; all of which are commonly assigned to the assignee of the present invention and all of which are hereby incorporated by reference. Although some systems include a liquid receiver for storing excess refrigerant during the reheat mode, such systems can be expensive due to the cost of the added receiver and associated control valves. Consequently, a need exists for a simpler, more cost effective refrigerant reheat system.

SUMMARY OF THE INVENTION

It is an object of the present invention to provide a simpler, more cost effective refrigerant system with a reheat mode.

Another object of some embodiments is to adjust a refrigerant system's effective charge without using a liquid receiver dedicated for that purpose.

Another object of some embodiments is to monitor and control the amount of subcooling occurring in a reheat coil.

Another object of some embodiments is to adjust a refrigerant system's effective charge by using the auxiliary side connector of an expansion valve, wherein the auxiliary side connector is downstream of the valve's flow restriction and upstream of the valve's multi-line flow distributor.

Another object of some embodiments is to control the amount of subcooling in a reheat coil by adjusting a system's effective refrigerant charge.

Another object of some embodiments is to determine the level of subcooling in a reheat coil by sensing the temperature of the refrigerant leaving the coil and sensing the temperature of the refrigerant at a strategic intermediate point within the coil.

Another object of some embodiments is to switch the operation of a refrigerant system between a cooling-only mode and a reheat mode by selectively deactivating a main condenser or a reheat coil.

Another object of some embodiments is to store liquid refrigerant in an inactive condenser during a reheat mode.

Another object of some embodiments is to use a plurality of simple check valves to minimize the use of solenoid valves and other externally actuated control valves in switching a refrigerant system between a cooling-only mode and a reheat mode.

Another object of some embodiments is to use a combination evaporator and reheat coil that share a common set of heat exchanger fins rather than using two individual heat exchangers for cooling and reheat functions.

Another object of some embodiments is to reverse a refrigerant's direction of flow through a reheat portion of a heat exchanger while leaving the refrigerant's direction of flow through an evaporator the unchanged.

Another object of some embodiments is to deactivate a condenser during a reheat mode of operation.

Another object of some embodiments is to use a reheat coil in both a reheat mode and a cooling-only mode, wherein the reheat coil provides heat in the reheat mode and provides cooling in the cooling-only mode.

One or more of these and/or other objects of the invention are provided by a refrigerant system that is selectively operable in cooling mode and a reheat mode, wherein a main condenser is deactivated in the reheat mode and in some cases excess liquid refrigerant is stored therein.

DESCRIPTION OF THE PREFERRED EMBODIMENT

Figure 1:
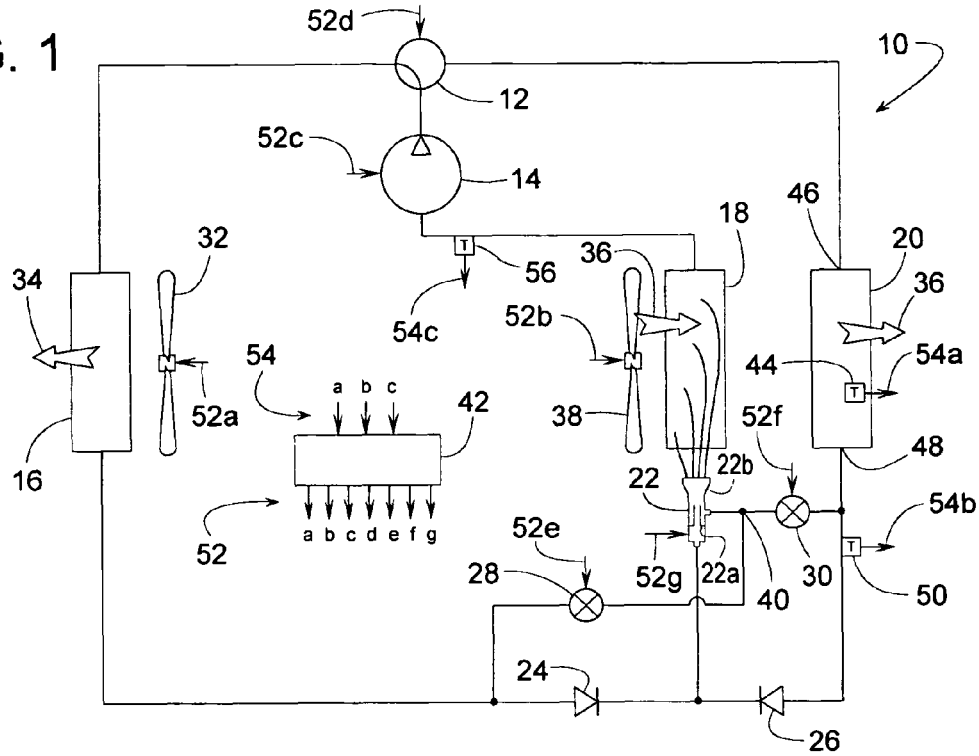
FIG. 1 is a schematic view of a refrigerant system selectively operating in a cooling mode.
Figure 2:
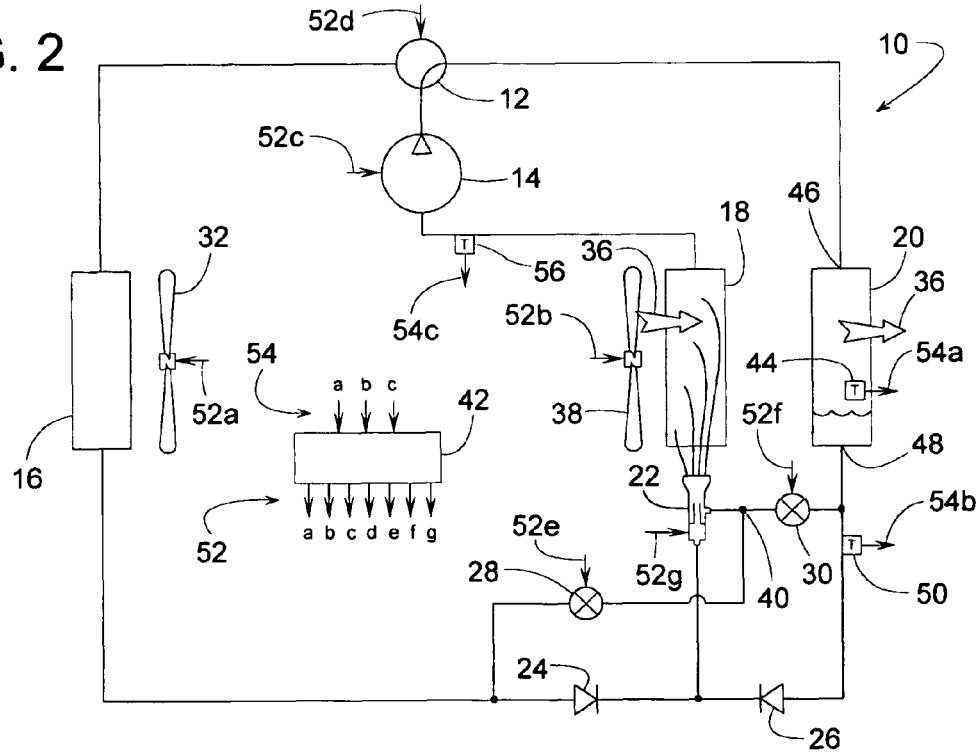
FIG. 2 is a schematic view of the refrigerant system of FIG. 1 but shown operating in a reheat mode.

A refrigerant system 10 includes a directional valve 12 that can configure system 10 in a cooling mode as shown in FIG. 1 or a reheat mode as shown in FIG. 2. System 10 generally operates in the cooling mode to meet sensible and latent cooling demands of a room or area in a building when the room temperature is appreciably above a target temperature. The reheat mode is typically used to address the latent cooling or dehumidifying demand when the room temperature is near or below the target temperature.

For the embodiment of FIGS. 1 and 2, system 10 comprises a compressor 14, a condenser 16, an evaporator 18, a reheat coil 20, an expansion device 22 (e.g., thermal expansion valve, electronic expansion valve, orifice, capillary, etc.), and various valves that may include one or more of the following: a check valve 24, a check valve 26, a solenoid valve 28 and a solenoid valve 30.

In the cooling mode, directional valve 12 directs relatively high-pressure, high-temperature refrigerant discharged from compressor 14 to condenser 16, and reheat coil 20 is generally inactive. An outdoor fan 32 can be energized to force outside air 34 across condenser 16 so that air 34 cools and condenses the refrigerant in condenser 16. From condenser 16, the refrigerant flows sequentially through check valve 24 and expansion device 22. Upon passing through expansion device 22, the refrigerant cools by expansion before entering evaporator 18. The refrigerant flowing through evaporator 18 can cool a stream of air 36 that an indoor fan 38 forces across evaporator 18 and the currently inactive reheat coil 20. After passing through evaporator 18, the refrigerant returns to compressor 14 to perpetuate the cooling cycle.

In the cooling mode, check valve 26 inhibits liquid refrigerant from bypassing expansion device 22 thereby preventing the flooding of the inactive reheat coil 20. Solenoid valve 28 is closed to inhibit refrigerant from bypassing check valve 24 and expansion device 22. Solenoid valve 30 is normally kept open continuously. When open, solenoid valve 30 can convey refrigerant from reheat coil 20 to a point 40 between expansion valve 22 and evaporator 18.

In a currently preferred embodiment, point 40 is an auxiliary side port of expansion device 22, wherein expansion device 22 in this case comprises a Sporlan expansion valve p/n OZE-25-ZGA (expansion valve 22*a*), a Sporlan multiline distributor p/n 1117-13-1/4"-C17 (multiline distributor 22*b*), and a Sporlan auxiliary side port connector p/n ASC-11-7 (point 40). Sporlan is based in Washington, Mo. and is a division of Parker Hannifin Corporation. Point 40 is downstream of Sporlan expansion valve p/n OZE-25-ZGA (expansion valve 22*a*) and upstream of Sporlan multi-line distributor p/n 1117-13-1/4"-C17 (multiline distributor 22*b*). Since multiline distributor 22*b* is downstream of expansion valve 22*a* and point 40 is not upstream of expansion valve 22*a*, it naturally follows that flow from point 40 to multiline distributor 22*b* does so via bypassing expansion valve 22*a*. Although the Sporlan assembly is currently preferred, other examples of expansion device 22 are well within the scope of the invention.

In the reheat mode, as shown in FIG. 2, condenser 16 is generally inactive, and directional valve 12 directs relatively high-pressure, high-temperature refrigerant from compressor 14 to reheat coil 20, thereby heating coil 20. From reheat coil 20, the refrigerant flows sequentially through check valve 26 and expansion device 22. Upon passing through expansion device 22, the refrigerant cools by expansion before entering evaporator 18, thereby cooling evaporator 18. To remove latent heat from air stream 36, air stream 36 is cooled by evaporator 18 and heated by reheat coil 20. After passing through evaporator 18, the refrigerant returns to compressor 14 to perpetuate the reheat cycle.

During the reheat mode, check valve 24 inhibits liquid refrigerant from backflowing into inactive condenser 16. Directional valve 12 and solenoid valves 28 and 30 are controlled to maintain a desired level of subcooling in reheat coil 20. To do this, a system controller 42 determines and monitors the level of subcooling in reheat coil 20 and compares the level to an established subcooling target. The subcooling target can be a predetermined range of acceptable values, wherein the range lies between certain upper and lower limits.

In some embodiments, controller 42 (e.g., computer, programmable logic controller, or suitable electrical circuit) determines the level of subcooling in reheat coil 20 based on the difference between a first refrigerant temperature and a second refrigerant temperature, wherein a first sensor 44 monitors the first temperature at a first point that is between an inlet 46 and an outlet 48 of reheat coil 20, and a second sensor 50 monitors the second temperature at a second point that is downstream of the first point. The location of the first point can be about twice as far from inlet 46 than from outlet 48 so that the first temperature reflects the refrigerant's saturated temperature within reheat coil 20. The second point is preferably near outlet 48 so that the difference between the first and second temperatures, as determined by controller 42, reflects the level of subcooling in reheat coil 20.

If the level of subcooling is substantially at the subcooling target (e.g., within the predetermined acceptable range), controller 42 leaves solenoid valves 28 and 30 closed. Valve 28 being closed generally traps a substantially fixed amount of liquid refrigerant within condenser 16, and valve 30 being closed prevents subcooled liquid refrigerant within reheat coil 20 from bypassing expansion device 22 and rushing into evaporator 18.

If the level of subcooling is below the subcooling target, controller 42 opens solenoid valve 28 while leaving solenoid valve 30 closed. This allows solenoid valve 28 to convey liquid refrigerant from condenser 16 to evaporator 18 and ultimately to reheat coil 20 as compressor 14 forces gaseous refrigerant from evaporator 18 to reheat coil 20. Once the subcooling level increases to the subcooling target, controller 42 closes valve 28 while valve 30 is already closed.

If the level of subcooling is above the subcooling target, controller 42 temporarily shifts directional valve 12 to its position of FIG. 1 and opens solenoid valve 30. Valve 30 being open conveys liquid refrigerant from reheat coil 20 to the inlet of evaporator 18, and directional valve 12 allows compressor 14 to force refrigerant from evaporator 18 to condenser 16, thus effectively transferring refrigerant from reheat coil 20 to condenser 16. After the subcooling level decreases to the subcooling target, controller 42 shifts directional valve 12 to its position of FIG. 2 and closes valve 30 while valve 28 is already closed.

To carry out the operations just described with respect to the cooling and reheat modes, controller 42 can provide one or more various output signals 52 in response to one or more various input signals 54. Examples of inputs 54 might include, but are not limited to, an input 54*a* from temperature sensor 44 and an input 54*b* from temperature sensor 50. Examples of outputs 52 might include, but are not limited to, an output 52*a* to control fan 32, an output 52*b* to control fan 38, an output 52*c* to control compressor 14, an output 52*d* to control directional valve 12, an output 52*e* to control solenoid valve 28, and an output 52*f* to control solenoid valve 30. In cases where expansion device 22 is an electronic expansion valve, controller 42 controls device 22 via an output signal 52*g* in response to a leaving refrigerant evaporator temperature input 54*c* from a temperature sensor 56. In cases where expansion device 22 is a thermal expansion valve, signal 54*c* might control expansion device 22 directly. If expansion device 22 has a fixed flow restriction as opposed to having an adjustable one, signal 52*g* might be eliminated.

Figure 3:
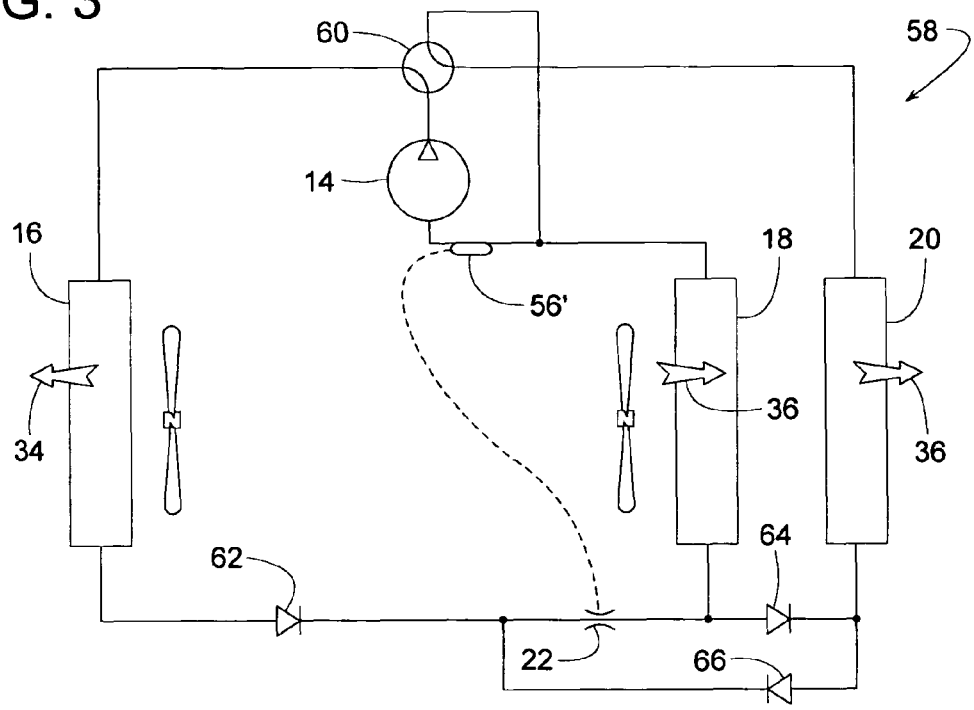
FIG. 3 is a schematic view of another refrigerant system selectively operating in a normal cooling mode.
Figure 4:
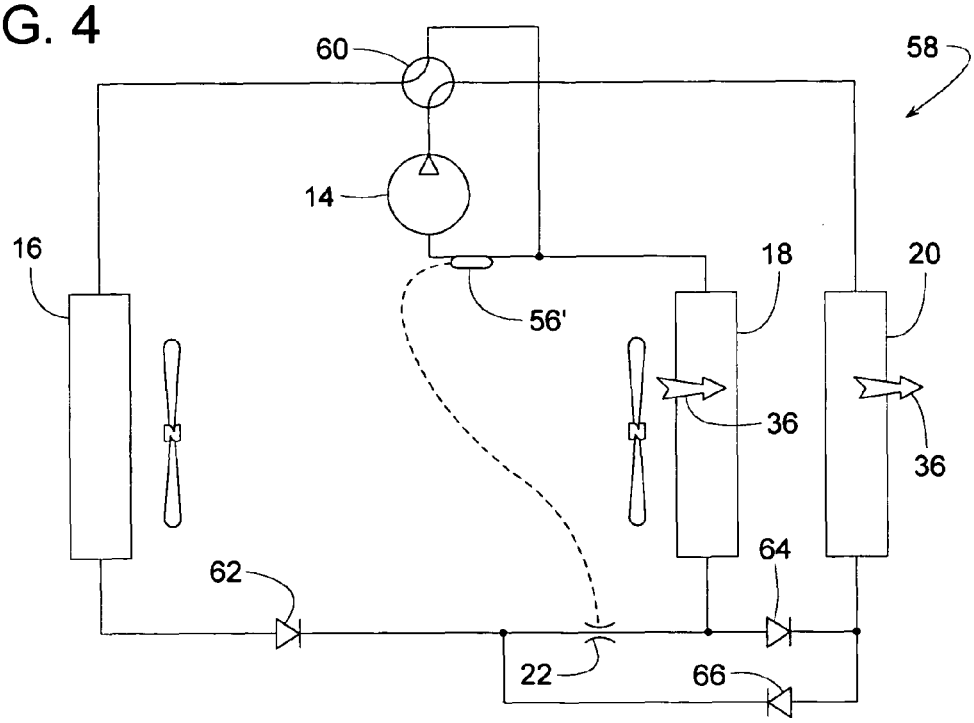
FIG. 4 is a schematic view of the refrigerant system of FIG. 3 but shown operating in a reheat mode.

In an alternate embodiment, shown in FIGS. 3 and 4, a refrigerant system 58 comprises compressor 14, condenser 16, evaporator 18, reheat coil 20, expansion device 22, a directional valve 60, and three check valves 62, 64 and 66. For illustration, expansion device 22 is shown as a thermal expansion valve being controlled by a conventional temperature bulb 56' on the suction line leading to compressor 14; however, other types of expansion devices (e.g., electronic expansion valve, fixed orifice, capillary, etc.) are well within the scope of the invention. Evaporator 18 and reheat coil 20 are connected in parallel flow relationship with respect to the flow of refrigerant and are disposed in series flow relationship with respect to air stream 36. Although evaporator 18 and reheat coil 20 are schematically illustrated as two separate heat exchangers, they can actually be a single unit with multiple rows of refrigerant conduit sharing common heat transfer fins. Directional valve 60 determines whether system 58 is operating in a cooling mode, as shown in FIG. 3, or operating in a reheat mode, as shown in FIG. 4.

In the cooling mode, directional valve 60 directs refrigerant from compressor 14 to condenser 16 where air 34 cools and condenses the refrigerant therein. From condenser 16, the refrigerant flows sequentially through check valve 62 (first check valve) and expansion device 22. Upon passing through expansion device 22, the refrigerant cools by expansion. After passing through expansion device 22, a first portion of the cooled refrigerant enters evaporator 18 while a second portion passes through check valve 64 (second check valve) to enter reheat coil 20 now functioning as a supplemental evaporator. Check valve 66 (third check valve) prevents liquid refrigerant leaving condenser 16 from bypassing expansion device 22. The refrigerant in evaporator 18 and reheat coil 20 cool air stream 36. After passing through their respective heat exchangers, both portions of the refrigerant return to the suction side of compressor 14 to perpetuate the cooling cycle.

In the reheat mode, shown in FIG. 4, condenser 16 is generally inactive, and directional valve 60 directs refrigerant from compressor 14 to reheat coil 20, thereby heating coil 20. From reheat coil 20, the refrigerant flows sequentially through check valve 66 and expansion device 22. Check valve 62 prevents liquid refrigerant from backflowing into condenser 16, and check valve 64 prevents liquid refrigerant leaving reheat coil 20 from bypassing expansion device 22 and flowing directly into evaporator 18. Upon passing through expansion device 22, the refrigerant cools by expansion before entering evaporator 18, thereby cooling evaporator 18. To remove latent heat from air stream 36, air stream 36 is cooled by evaporator 18 and heated by reheat coil 20. After passing through evaporator 18, the refrigerant returns to compressor 14 to perpetuate the reheat cycle.

In the cooling mode, the refrigerant flows in a forward direction through reheat coil 20, but in the reheat mode, the refrigerant flows in a reverse direction through reheat coil 20. The refrigerant passing through evaporator 18, however, flows in the same predetermined direction regardless of whether system 58 is operating in the cooling or reheat mode.

Figure 5:
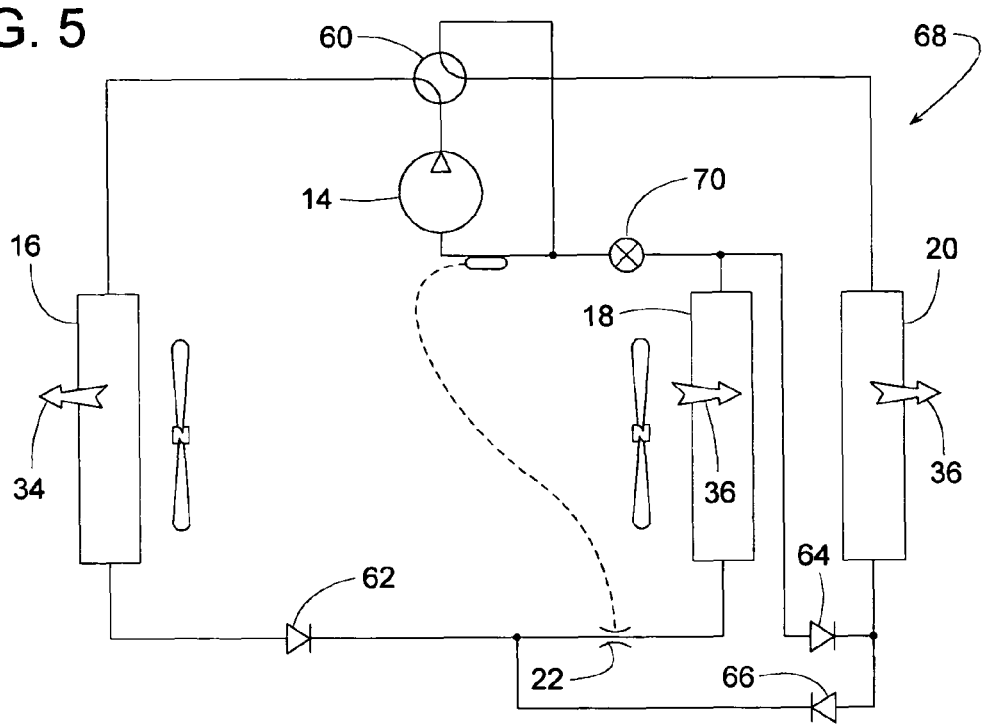
FIG. 5 is a schematic view of another refrigerant system selectively operating in a normal cooling mode.
Figure 6:
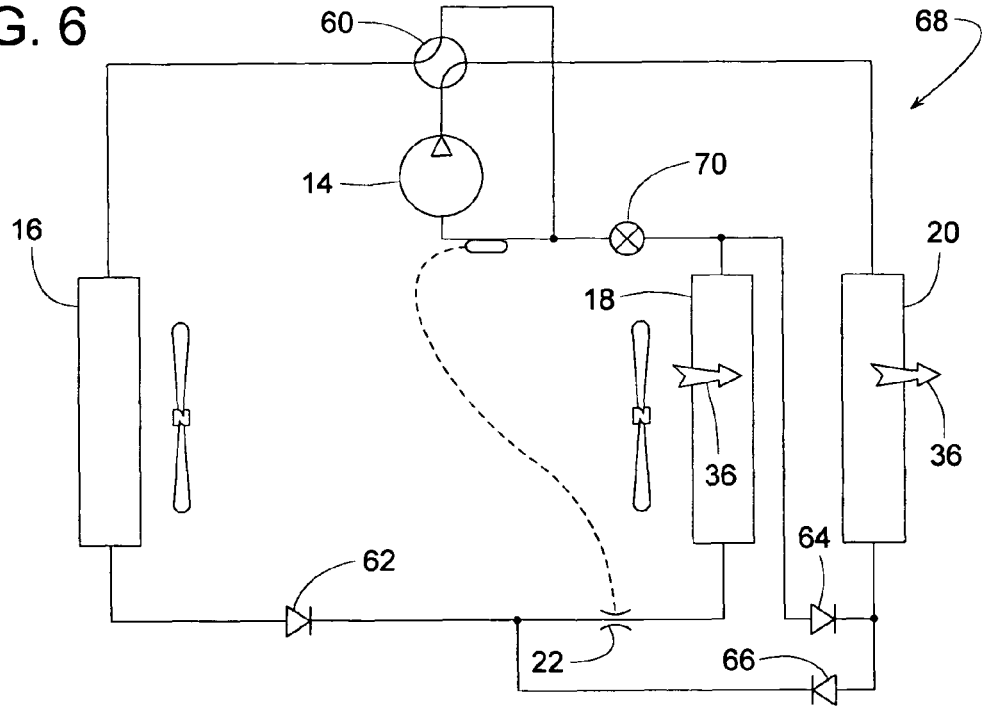
FIG. 6 is a schematic view of the refrigerant system of FIG. 5 but shown operating in a reheat mode.

In another embodiment, shown in FIGS. 5 and 6, a refrigerant system 68 comprises compressor 14, condenser 16, evaporator 18, reheat coil 20, expansion device 22, directional valve 60, a solenoid valve 70, and three check valves 62, 64 and 66. Evaporator 18 and reheat coil 20 are connected in series flow relationship with respect to the flow of refrigerant and air stream 36. Directional valve 60 determines whether system 68 is operating in a cooling mode, as shown in FIG. 5, or operating in a reheat mode, as shown in FIG. 6.

In the cooling mode, directional valve 60 directs refrigerant from compressor 14 to condenser 16 where air 34 cools and condenses the refrigerant therein. From condenser 16, the refrigerant flows sequentially through check valve 62 and expansion device 22. Upon passing through expansion device 22, the refrigerant cools by expansion. After passing through expansion device 22, the cooled refrigerant passes through evaporator 18. From evaporator 18, check valve 64 conveys the refrigerant through reheat coil 20 (functioning as a supplemental evaporator). Solenoid valve 70 is closed to prevent refrigerant leaving evaporator 18 from bypassing reheat coil 20, and check valve 66 prevents liquid refrigerant leaving condenser 16 from bypassing expansion device 22. The refrigerant in evaporator 18 and reheat coil 20 cool air stream 36. After passing sequentially through evaporator 18 and reheat coil 20, the refrigerant returns to the suction side of compressor 14 to perpetuate the cooling cycle.

In the reheat mode, shown in FIG. 6, condenser 16 is generally inactive, solenoid valve 70 is open, and directional valve 60 directs refrigerant from compressor 14 to reheat coil 20, thereby heating coil 20. From reheat coil 20, the refrigerant flows sequentially through check valve 66 and expansion device 22. Check valve 62 prevents liquid refrigerant from backflowing into condenser 16, and check valve 64 prevents liquid refrigerant leaving reheat coil 20 from bypassing expansion device 22 and evaporator 18. Upon passing through expansion device 22, the refrigerant cools by expansion before entering evaporator 18, thereby cooling evaporator 18. To remove latent heat from air stream 36, air stream 36 is cooled by evaporator 18 and heated by reheat coil 20. After passing through evaporator 18, open solenoid valve 70 conveys the refrigerant back to compressor 14 to perpetuate the reheat cycle.

In the cooling mode, the refrigerant flows in a forward direction through reheat coil 20, but in the reheat mode, the refrigerant flows in a reverse direction through reheat coil 20. The refrigerant passing through evaporator 18, however, flows in the same predetermined direction regardless of whether system 68 is operating in the cooling or reheat mode.

Figure 7:
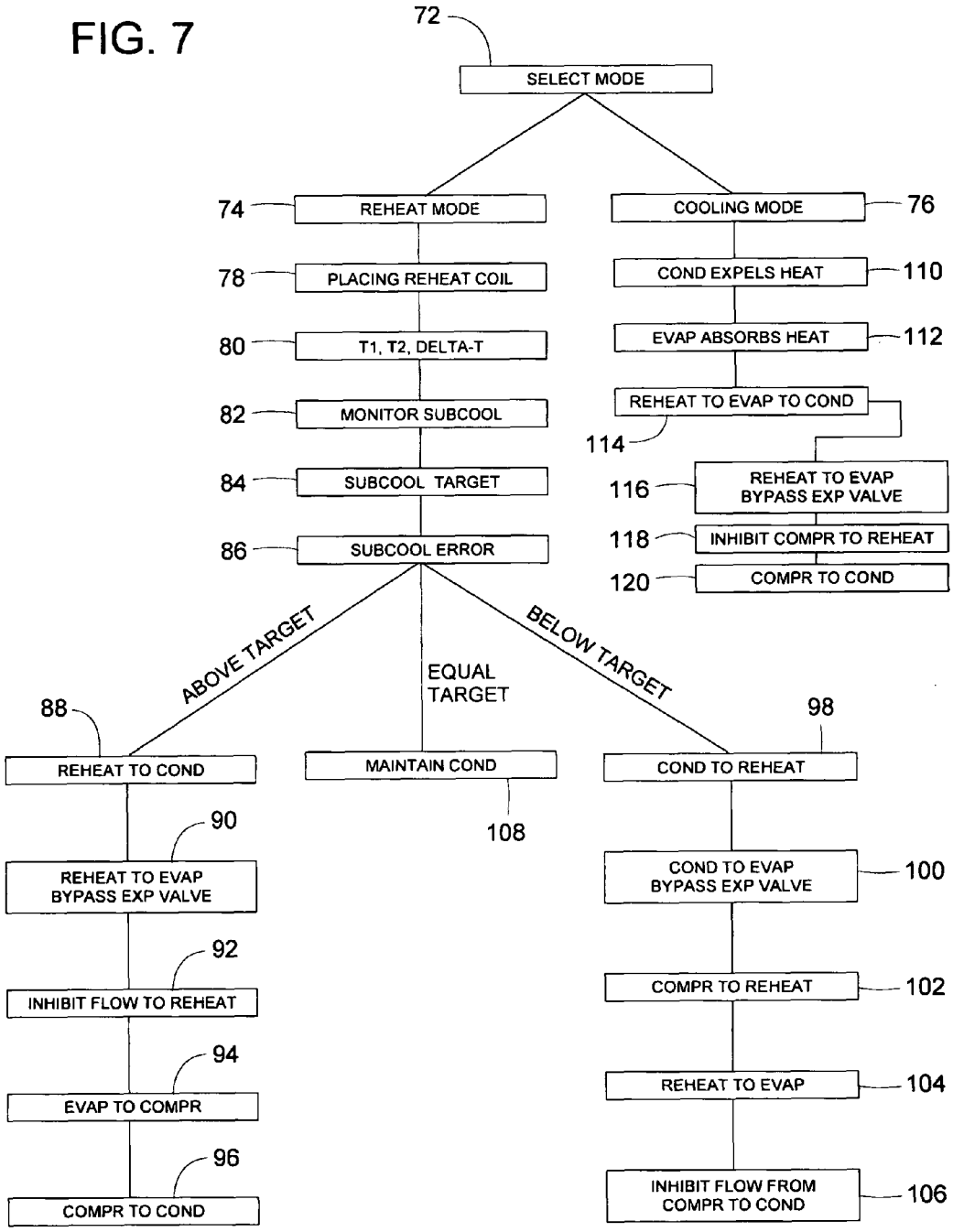
FIG. 7 is an algorithm that illustrates various method steps recited in the claims.
Figure 8:
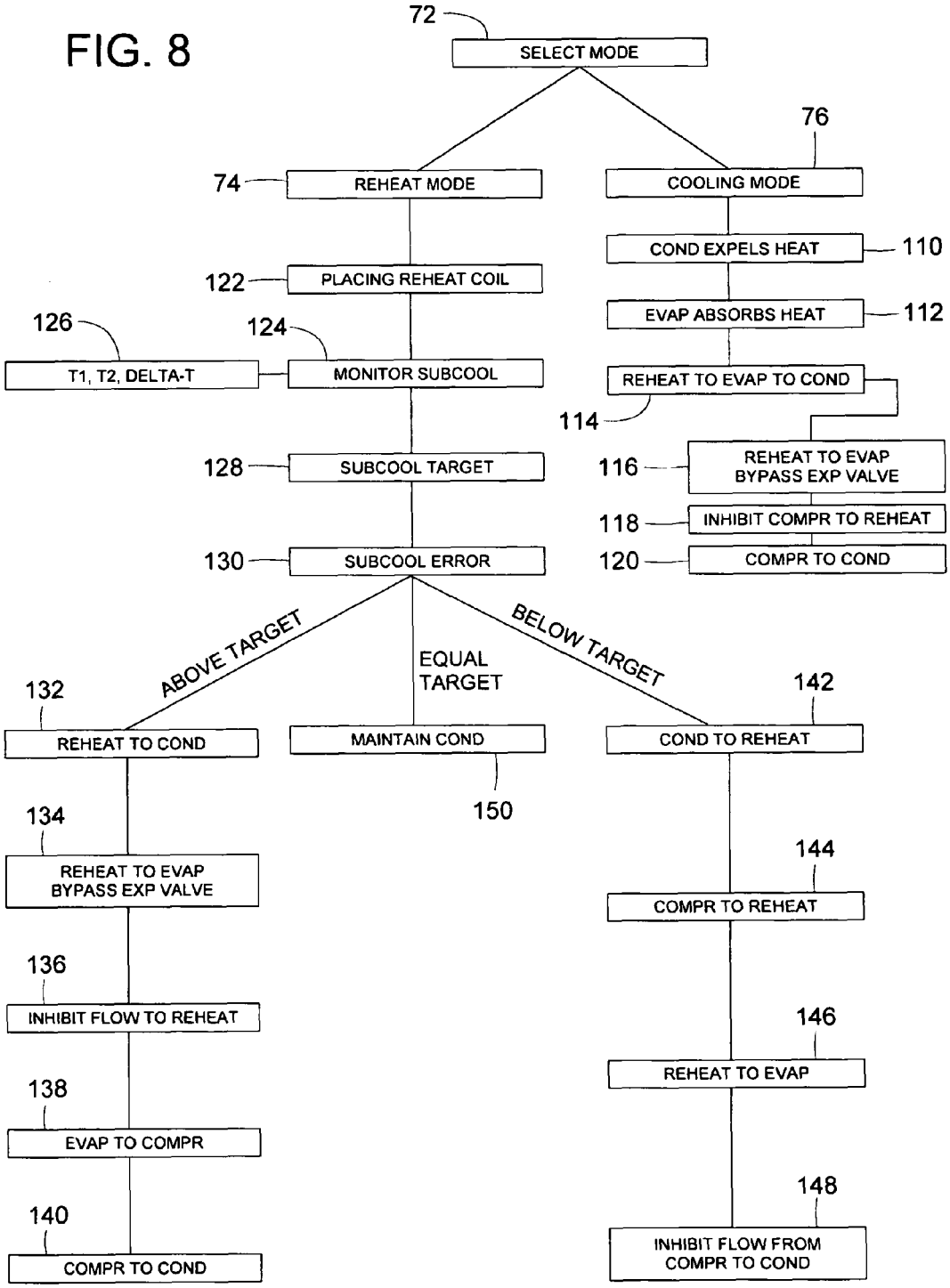
FIG. 8 is another algorithm that illustrates various method steps recited in the claims.

FIGS. 7 and 8 show algorithms according to which refrigerant systems 10, 58 and/or 68 can operate. Block 72 represents selecting the refrigerant system's operating mode using valve 12 or 60. Block 74 represents the refrigerant system operating in the reheat mode. Block 76 represents the refrigerant system operating in the cooling mode.

Block 78 represents placing the reheat coil in heat exchange relationship with the stream of air.

Block 80 represents sensing a second temperature of the refrigerant at a second point that is downstream of the first point with respect to the refrigerant flowing through the reheat coil; determining a difference between the first temperature and the second temperature; and during the reheat mode, monitoring a level of subcooling occurring in the reheat coil, wherein the level of subcooling is a function of the difference.

Block 82 represents during the reheat mode, monitoring a level of subcooling occurring in the reheat coil, wherein the level of subcooling is a function of the difference between the first temperature and the second temperature.

Block 84 represents establishing a subcooling target.

Block 86 represents comparing the level of subcooling to the subcooling target, thereby determining whether the level of subcooling during the reheat mode is above the subcooling target, below the subcooling target, or at the subcooling target.

Blocks 88-96 represent when the level of subcooling is above the subcooling target during the reheat mode, shifting refrigerant out of the reheat coil and into the condenser by doing the following: (block 90) conveying refrigerant from the reheat coil into the evaporator via a route that bypasses the expansion valve; (block 92) momentarily inhibiting refrigerant from flowing into the reheat coil; (block 94) conveying refrigerant from the evaporator into the compressor; and (block 96) momentarily discharging the refrigerant from the compressor into the condenser.

Blocks 98-106 represent when the level of subcooling is below the subcooling target during the reheat mode, shifting liquid refrigerant out of the condenser and into reheat coil by doing the following: (block 100) momentarily conveying refrigerant from the condenser to the evaporator via a route that bypasses the expansion valve; (block 102) discharging refrigerant from the compressor to the reheat coil; (block 104) via the expansion valve, conveying refrigerant from the reheat coil to the evaporator; and (block 106) inhibiting the refrigerant from flowing from the compressor into the condenser.

Block 108 represents when the level of subcooling is at the subcooling target during the reheat mode, maintaining a substantially fixed amount of refrigerant in the condenser.

Block 110 represents during the cooling mode, transferring heat from the refrigerant in the condenser.

Block 112 represents during the cooling mode, transferring heat to the refrigerant in the evaporator.

Block 114 represents during the cooling mode, momentarily transferring refrigerant in a liquid state from the reheat coil through the evaporator to the condenser and subsequently rendering the reheat coil substantially inactive. Blocks 116-120 represent performing block 114 by doing the following: (block 116) momentarily conveying refrigerant from the reheat coil to the evaporator via a route that bypasses the expansion valve; (block 118) inhibiting the compressor from discharging refrigerant into the reheat coil; and (block 120) discharging refrigerant from the compressor to the condenser.

Referring to FIG. 8, block 122 represents placing the reheat coil in heat exchange relationship with the stream of air with the reheat coil being downstream of the evaporator with respect to the stream of air.

Block 124 represents during the reheat mode, monitoring a level of subcooling occurring in the reheat coil.

Block 126 represents performing block 124 by sensing a first temperature of the refrigerant at a first point that is between a refrigerant inlet and a refrigerant outlet of the reheat coil; sensing a second temperature of the refrigerant at a second point that is downstream of the first point with respect to the refrigerant flowing through the reheat coil; and determining a difference between the first temperature and the second temperature, wherein the level of subcooling is a function of the difference.

Block 128 represents establishing a subcooling target.

Block 130 represents comparing the level of subcooling to the subcooling target, thereby determining whether the level of subcooling during the reheat mode is above the subcooling target, below the subcooling target, or at the subcooling target.

Block 132 represents when the level of subcooling is above the subcooling target during the reheat mode, shifting refrigerant out of the reheat coil and into the condenser.

Block 142 represents when the level of subcooling is below the subcooling target during the reheat mode, shifting liquid refrigerant out of the condenser and into the reheat coil by momentarily conveying refrigerant from the condenser to the evaporator via a route that bypasses the expansion valve.

Block 150 represents when the level of subcooling is at the subcooling target during the reheat mode, trapping a substantially fixed amount of refrigerant in the condenser.

Blocks 134-140 represent simultaneously doing the following: (block 134) conveying refrigerant from the reheat coil into the evaporator via a route that bypasses the expansion valve; (block 136) momentarily inhibiting refrigerant from flowing into the reheat coil; (block 138) conveying refrigerant from the evaporator into the compressor; and (block 140) momentarily discharging refrigerant from the compressor into the condenser.

Blocks 144-148 represent performing block 142 by doing the following: (block 144) discharging refrigerant from the compressor to the reheat coil; (block 146) via the expansion valve, conveying refrigerant from the reheat coil to the evaporator; and (block 148) inhibiting the refrigerant from flowing from the compressor into the condenser.

Although the invention is described with respect to a preferred embodiment, modifications thereto will be apparent to those of ordinary skill in the art. The scope of the invention, therefore, is to be determined by reference to the following claims.

What is claimed is:

1. A method of selectively operating a refrigerant system in at least one of a cooling mode and a reheat mode, wherein the refrigerant system can circulate a refrigerant through a compressor, a condenser, an evaporator in heat exchange relationship with a stream of air, a reheat coil, and an expansion valve, the method comprising:

placing the reheat coil in heat exchange relationship with the stream of air with the reheat coil being downstream of the evaporator with respect to the stream of air;

during the reheat mode, monitoring a level of subcooling occurring in the reheat coil;

establishing a subcooling target;

comparing the level of subcooling to the subcooling target, thereby determining whether the level of subcooling during the reheat mode is above the subcooling target, below the subcooling target, or at the subcooling target;

when the level of subcooling is above the subcooling target during the reheat mode, shifting refrigerant out of the reheat coil and into the condenser by conveying refrigerant from the reheat coil into the evaporator via bypassing the expansion valve;

when the level of subcooling is below the subcooling target during the reheat mode, shifting liquid refrigerant out of the condenser and into the reheat coil by momentarily conveying refrigerant from the condenser to the evaporator via a route that bypasses the expansion valve; and when the level of subcooling is at the subcooling target during the reheat mode, trapping a substantially fixed amount of refrigerant in the condenser.

2. The method of claim 1, wherein the subcooling target is a range of values.

3. The method of claim 1, wherein the step of shifting refrigerant out of the reheat coil and into the condenser is carried out by simultaneously:

conveying refrigerant from the reheat coil into the evaporator;

momentarily inhibiting refrigerant from flowing into the reheat coil;

conveying refrigerant from the evaporator into the compressor; and momentarily discharging refrigerant from the compressor into the condenser.

4. The method of claim 1, further comprising during the cooling mode:

transferring heat from the refrigerant in the condenser;

transferring heat to the refrigerant in the evaporator; and momentarily conveying refrigerant in a liquid state from the reheat coil through the evaporator to the condenser and subsequently rendering the reheat coil substantially inactive.

5. The method of claim 4, wherein the step of momentarily conveying refrigerant in a liquid state from the reheat coil through the evaporator to the condenser during the cooling mode is carried out by:

momentarily conveying refrigerant from the reheat coil to the evaporator via bypassing the expansion valve;

inhibiting the compressor from discharging refrigerant into the reheat coil; and discharging refrigerant from the compressor to the condenser.

6. The method of claim 1, wherein the step of monitoring the level of subcooling occurring in the reheat coil is carried out by:

sensing a first temperature of the refrigerant at a first point that is between a refrigerant inlet and a refrigerant outlet of the reheat coil;

sensing a second temperature of the refrigerant at a second point that is downstream of the first point with respect to the refrigerant flowing through the reheat coil; and determining a difference between the first temperature and the second temperature, wherein the level of subcooling is a function of the difference.

7. A method of selectively operating a refrigerant system in a cooling mode and a reheat mode, wherein the refrigerant system can circulate a refrigerant through a compressor, a condenser, an evaporator in heat exchange relationship with a stream of air, a reheat coil, and an expansion valve, the method comprising:

placing the reheat coil in heat exchange relationship with the stream of air;

sensing a first temperature of the refrigerant at a first point that is between a refrigerant inlet and a refrigerant outlet of the reheat coil;

sensing a second temperature of the refrigerant at a second point that is downstream of the first point with respect to the refrigerant flowing through the reheat coil;

determining a difference between the first temperature and the second temperature, during the reheat mode, monitoring a level of subcooling occurring in the reheat coil, wherein the level of subcooling is a function of the difference;

establishing a subcooling target;

comparing the level of subcooling to the subcooling target, thereby determining whether the level of subcooling during the reheat mode is above the subcooling target, below the subcooling target, or at the subcooling target;

when the level of subcooling is above the subcooling target during the reheat mode, shifting refrigerant out of the reheat coil and into the condenser by doing the following:

a) conveying refrigerant from the reheat coil into the evaporator via bypassing the expansion valve;

b) momentarily inhibiting refrigerant from flowing into the reheat coil;

c) conveying refrigerant from the evaporator into the compressor; and d) momentarily discharging the refrigerant from the compressor into the condenser.

8. The method of claim 7, when the level of subcooling is below the subcooling target during the reheat mode, shifting liquid refrigerant out of the condenser and into reheat coil by doing the following:

a) momentarily conveying refrigerant from the condenser to the evaporator via bypassing the expansion valve;

b) discharging refrigerant from the compressor to the reheat coil;

c) via the expansion device, conveying refrigerant from the reheat coil to the evaporator; and d) inhibiting the refrigerant from flowing from the compressor into the condenser.

9. The method of claim 8 wherein when the level of subcooling is at the subcooling target during the reheat mode, maintaining a substantially fixed amount of refrigerant in the condenser.

10. The method of claim 9, further comprising during the cooling mode:

transferring heat from the refrigerant in the condenser;

transferring heat to the refrigerant in the evaporator; and momentarily transferring refrigerant in a liquid state from the reheat coil through the evaporator to the condenser and subsequently rendering the reheat coil substantially inactive.

11. The method of claim 10, wherein the step of momentarily transferring refrigerant in a liquid state from the reheat coil through the evaporator to the condenser during the cooling mode is carried out by:

momentarily conveying refrigerant from the reheat coil to the evaporator via bypassing the expansion valve;

inhibiting the compressor from discharging refrigerant into the reheat coil; and discharging refrigerant from the compressor to the condenser.

12. A refrigerant system that contains a refrigerant that can exchange heat with an air stream, the refrigerant system comprising:

a compressor that discharges the refrigerant;

a condenser;

an expansion device;

an evaporator;

a reheat coil;

a first check valve in fluid communication with the condenser and the expansion device;

a second check valve in fluid communication with the evaporator and the reheat coil;

a third check valve in fluid communication with the first check valve, the second check valve, the expansion device, and the reheat coil; and a directional valve in fluid communication with the compressor and the reheat coil, the direction valve selectively configures the refrigerant system in a cooling mode and a reheat mode such that:

a) in the cooling mode:

i. the refrigerant flows through the condenser to cool the refrigerant, ii. the refrigerant flows through the evaporator in a predetermined direction to cool the air stream, and iii. the refrigerant flows from the condenser into the reheat coil in a forward direction to cool the air stream; and b) in the reheat mode:

i. the condenser is substantially inactive, ii. the refrigerant flows through the evaporator in the predetermined direction to cool the air stream, and iii. the refrigerant flows from the compressor into the reheat coil in a reverse direction to heat the air stream.

13. The refrigerant system of claim 12, further comprising a solenoid valve in fluid communication with the evaporator and the compressor, the solenoid valve has an open position and a closed position such that:

a) in the open position, the solenoid valve provides a flow path that allows the refrigerant flowing from the evaporator to bypass the reheat coil and enter the compressor, and b) in the closed position, the solenoid valve urges the refrigerant flowing from the evaporator to flow through the reheat coil before returning to the compressor.

14. The refrigerant system of claim 12, wherein the evaporator and the reheat coil are connected in parallel flow relationship with respect to the refrigerant and are disposed in series flow relationship with respect to the air stream when the refrigerant system is configured in the cooling mode.

15. The refrigerant system of claim 12, wherein the evaporator and the reheat coil are connected in parallel flow relationship with respect to the refrigerant and are disposed in series flow relationship with respect to the air stream when the refrigerant system is configured in the reheat mode.

16. The refrigerant system of claim 12, wherein the evaporator and the reheat coil are connected in series flow relationship with respect to both the refrigerant and the air stream when the refrigerant system is configured in the cooling mode.

17. The refrigerant system of claim 12, wherein the evaporator and the reheat coil are connected in series flow relationship with respect to both the refrigerant and the air stream when the refrigerant system is configured in the reheat mode.

18. The refrigerant system of claim 12, wherein the first check valve inhibits the refrigerant from flowing from the reheat coil to the condenser when the refrigerant system is the reheat mode.

19. The refrigerant system of claim 12, wherein the first check valve conveys the refrigerant from condenser to the expansion device when the refrigerant system is in the cooling mode.

20. The refrigerant system of claim 12, wherein the second check valve inhibits the refrigerant from flowing from the reheat coil to the evaporator when the refrigerant system is the reheat mode.

21. The refrigerant system of claim 12, wherein the second check valve conveys the refrigerant toward the reheat coil when the refrigerant system is in the cooling mode.

22. The refrigerant system of claim 12, wherein the third check valve inhibits the refrigerant from entering the reheat coil before the refrigerant passes through expansion device when the refrigerant system is the cooling mode.

23. The refrigerant system of claim 12, wherein the third check valve conveys the refrigerant from the reheat coil to the expansion device when the refrigerant system is in the reheat mode.

24. A refrigerant system including a cooling mode and a reheat mode, the refrigerant system comprising:

a compressor, a condenser, an evaporator in heat exchange relationship with a stream of air, a reheat coil in heat exchange relationship with the stream of air with the reheat coil being downstream of the evaporator with respect to the stream of air, and an expansion valve;

means for sensing a first temperature of the refrigerant at a first point that is between a refrigerant inlet and a refrigerant outlet of the reheat coil;

means for sensing a second temperature of the refrigerant at a second point that is downstream of the first point with respect to the refrigerant flowing through the reheat coil;

means for determining a difference between the first temperature and the second temperature, means for, during the reheat mode, monitoring a level of subcooling occurring in the reheat coil, wherein the level of subcooling is a function of the difference;

means for establishing a subcooling target;

means for comparing the level of subcooling to the subcooling target, thereby determining whether the level of subcooling during the reheat mode is above the subcooling target, below the subcooling target, or at the subcooling target;

first means for, when the level of subcooling is above the subcooling target during the reheat mode, shifting refrigerant out of the reheat coil and into the condenser by conveying refrigerant from the reheat coil into the evaporator via bypassing the expansion valve; and second means for, when the level of subcooling is below the subcooling target during the reheat mode, shifting liquid refrigerant out of the condenser and into reheat coil by momentarily conveying refrigerant from the condenser to the evaporator via a route that bypasses the expansion valve.

25. The system of claim 24 wherein the first shifting means includes:

means for momentarily inhibiting refrigerant from flowing into the reheat coil;

means for conveying refrigerant from the evaporator into the compressor; and means for momentarily discharging the refrigerant from the compressor into the condenser.

26. The system of claim 25 wherein the second shifting means includes means for momentarily conveying refrigerant from the condenser to the evaporator via bypassing the expansion valve;

means for discharging refrigerant from the compressor to the reheat coil;

means for via the expansion device, conveying refrigerant from the reheat coil to the evaporator; and means for inhibiting the refrigerant from flowing from the compressor into the condenser.

27. The system of claim 24 further including means for, when the level of subcooling is at the subcooling target during the reheat mode, maintaining a substantially fixed amount of refrigerant in the condenser.

* * * * *